United States Patent [19]

Fabry

[11] Patent Number: 4,684,123

[45] Date of Patent: Aug. 4, 1987

[54] EXERCISE GARMENT

[76] Inventor: Jonn J. Fabry, 226 Miramar, Green Bay, Wis. 54301

[21] Appl. No.: 739,881

[22] Filed: May 31, 1985

[51] Int. Cl.[4] ..... A63B 21/12

[52] U.S. Cl. ..... 272/119; 2/161 A

[58] Field of Search ..... 272/119, 93, 96; 2/159, 2/160, 161 R, 161 A, 162, 170, DIG. 11, DIG. 6; 273/54 B; 128/165, 159, 403

[56] References Cited

U.S. PATENT DOCUMENTS

| | | | |
|---|---|---|---|
| 2,187,987 | 1/1940 | Sherrick | 273/54 B |
| 2,831,196 | 4/1958 | Scheiber | 2/161 |
| 3,124,806 | 3/1964 | Campbell et al. | 273/54 B |
| 3,149,839 | 9/1964 | Materia | 272/119 X |
| 3,588,105 | 6/1971 | Donohoe | 272/119 X |
| 3,924,851 | 12/1975 | Winston | 272/119 X |
| 4,034,979 | 7/1977 | Wester | 272/119 X |
| 4,189,141 | 2/1980 | Rooney | 272/119 X |
| 4,247,097 | 1/1981 | Schwartz | 272/119 |
| 4,268,917 | 5/1981 | Massey | 272/119 X |
| 4,326,706 | 4/1982 | Guthrie et al. | 272/119 |
| 4,330,120 | 5/1982 | Netti | 272/119 |

FOREIGN PATENT DOCUMENTS

| | | | |
|---|---|---|---|
| 509276 | 7/1939 | Austria | 272/119 |

*Primary Examiner*—Richard J. Apley
*Assistant Examiner*—J. Welsh
*Attorney, Agent, or Firm*—Foley & Lardner

[57] ABSTRACT

This invention relates to weighted exercise garment, particularly a glove having one or more elastic pockets on the outside thereof on a back portion of the glove which covers the back of the hand. One or more weights are inserted into the elastic pockets in order to change the total weight of the exercise glove, and can be secured in the pockets. A further aspect of the present invention relates to an exercise garment having a unique closure utilizing releasable contact fasteners, which closure functions to secure the weights in the pockets and secure the garment to the wearer's body. In a preferred embodiment, a row of pockets is employed, and the closure is used to simultaneously open or close all of the pockets. The invention is advantageous in that it allows the wearer to conveniently change the amount of weight carried in the exercise garment.

11 Claims, 10 Drawing Figures

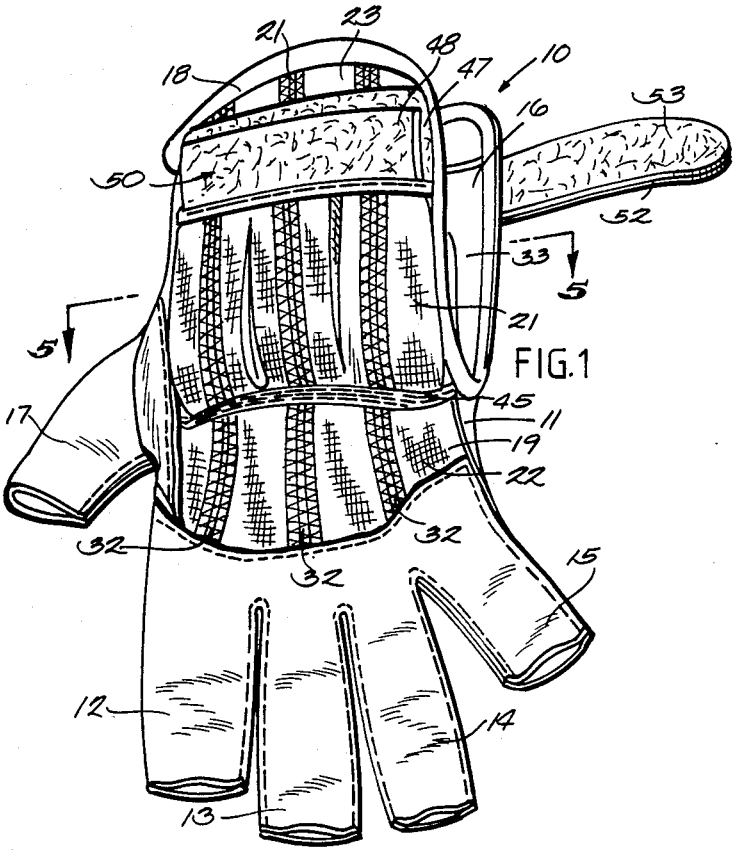
FIG.1
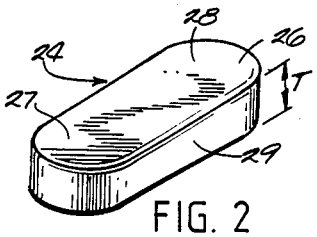
FIG. 2
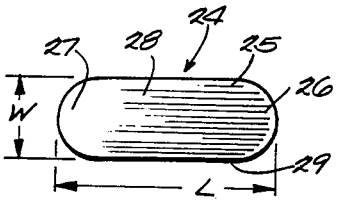
FIG. 3
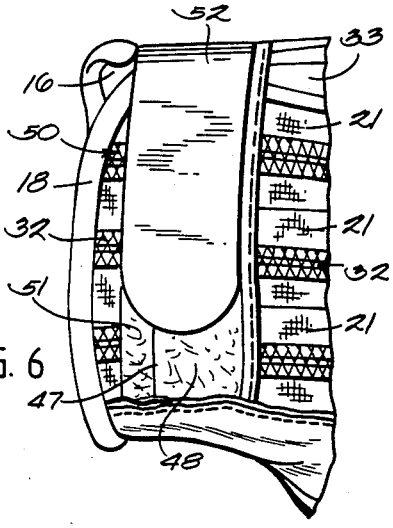
FIG. 6
FIG 4
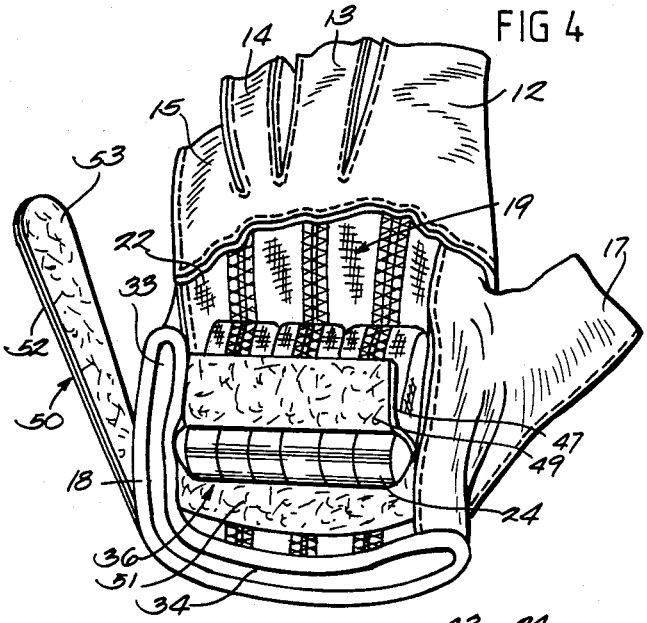
FIG. 7
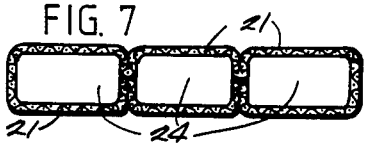
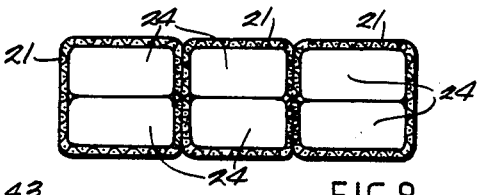
FIG.8
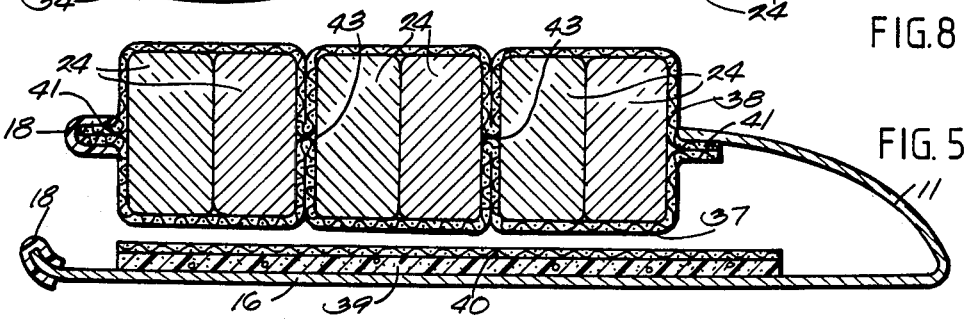
FIG. 5

EXERCISE GARMENT

FIELD OF THE INVENTION

The present invention relates to an improved weighted exercise garment, and more particularly to an exercise glove having an interchangeable weight load system whereby the wearer can readily add or remove weights from the glove in order to increase or decrease the total weight of the glove.

BACKGROUND OF THE INVENTION

In general, exercise garments including gloves, boots and belts incorporating built-in weights are well known. Examples of such prior art exercise garments are described in U.S. Pat. Nos. 3,759,510 to Jackson, Jr., issued Sept. 18, 1973; 1,729,209 to Curtice, issued Sept. 24, 1929; and 2,241,833 to Waller, issued May 13, 1941. Weighted exercise gloves are disclosed in U.S. Pat. Nos. 3,838,853 to Fredenhagen, issued Oct. 1, 1974; 4,034,979 to Wester, issued July 12, 1977, 4,330,120 to Netti, issued May 18, 1982; and 4,247,097 to Schwartz, issued Jan. 27, 1981.

These prior art exercise gloves are generally large, clumsy and do not provide a convenient means for increasing and decreasing the weight of the glove. The use of particulate weight material, or bags thereof, is highly disadvantageous. In addition, the gloves taught by the prior art do not provide a convenient interchangable weight load system in which the weights are snugly received in a pocket regardless of the number of weights the wearer chooses to load into the pocket.

Several of the foregoing patents disclose exercise garments having pockets which can be closed by means of releasable contact fasteners. Such releasable contact fasteners comprise a pair of elements which can be secured together merely by bringing the respective elements into mutual contact. Once secured in this manner, the elements generally strongly resist being pulled apart by forces acting in or near the plane of contact between the elements, but resist forces acting perpendicular to this plane of contact to a much lesser extent. Thus, a user or wearer releases the releasable contact fastener merely by pulling the elements apart in the appropriate direction. Typically, one of the elements is secured to the body of the garment, i.e. comprises a base element, so that the user releases the fastener by pulling the other element away from the base element. A popular type of releasable contact fastener utilizes a hook tape (a strip of fabric bearing a multiplicity of small hooks or barbs) cooperating with a loop tape (a strip of fabric bearing a pile of fine strands) such that, upon contact, the hook tape barbs releasably catch in the loop tape pile. Such fasteners are commercially available, e.g. under the trademark Velcro. Another type of releasable contact fastener comprises a pair of elements wherein at least one of the elements has a layer of adhesive thereon which releasably binds the elements together.

The use of hook tape/loop tape fasteners in connection with gloves is known. However, the prior art employs separate fastening mechanisms for the purposes of, for example, fastening pocket flaps and fastening the glove to the wearer's hand, thereby increasing the cost of the glove.

SUMMARY OF THE INVENTION

The present invention provides a weighted exercise garment which is relatively simple in design, attractive in appearance and highly versatile. According to one aspect of the invention, this garment is a glove having at least one pocket made of an elastic material positioned over the back of the wearer's hand. This elastic pocket can stretch to snugly hold one or more objects, such as like-shaped weights. The wearer can thus increase the total weight by inserting an additional weight into the pocket, or decrease the total weight by removing a weight from the pocket. The elastic pocket stretches in a direction transverse to the lengthwise direction of the golve to thereby hold from one up to a predetermined number, such as two or three, of the weights. The elastic pocket holds the weight or weights snugly, irrespective of how many weights are inside the elastic pocket, up to the predetermined maximum number.

According to another aspect of the invention, the garment includes a unique closure mechanism. The elastic pocket of this embodiment has a closure flap which has fastener elements on both of its sides. The fastener element on the underside of the closure flap cooperates with a fastener base element affixed to the body of the garment to close the elastic pocket. A strap, attached at one of its ends to the garment body, extends laterally from the garment body. This strap has a fastener element secured to one of its sides. To releasably secure the garment on the wearer's body, the wearer folds over the strap so that it overlies both the closure flap and a portion of the base element not covered by the closure flap. The fastener element on the strap thereby engages both the fastener This reinforces the closure of the pockets and also secures the garment on the wearer.

BRIEF DESCRIPTION OF THE DRAWING

A preferred exemplary embodiment of the present invention will hereinafter be described in conjunction with the appended drawing, wherein like numerals denote like elements, and:

FIG. 1 is a plan view of a weighted exercise glove according to the present invention;

FIG. 2 is a perspective view of a weight used in the exercise glove disclosed in FIG. 1;

FIG. 3 is a plan view of the weight shown in FIG. 2;

FIG. 4 is a rear perspective view of the glove shown in FIG. 1, with the pocket closure flap and closure strap in released positions;

FIG. 5 is a sectional view along the line 5—5 in FIG. 1;

FIG. 6 is a partial plan view of a rear portion of the glove shown in FIG. 1, with the closure flap and closure strap secured to the glove body;

FIG. 7 is a partial end view of elastic pockets according to the invention each containing one weight therein;

FIG. 8 is the same view as shown in FIG. 7, showing, however, an alternative configuration wherein each pocket holds two weights.

DETAILED DESCRIPTION OF PREFERRED EXEMPLARY EMBODIMENTS

Figure 9:
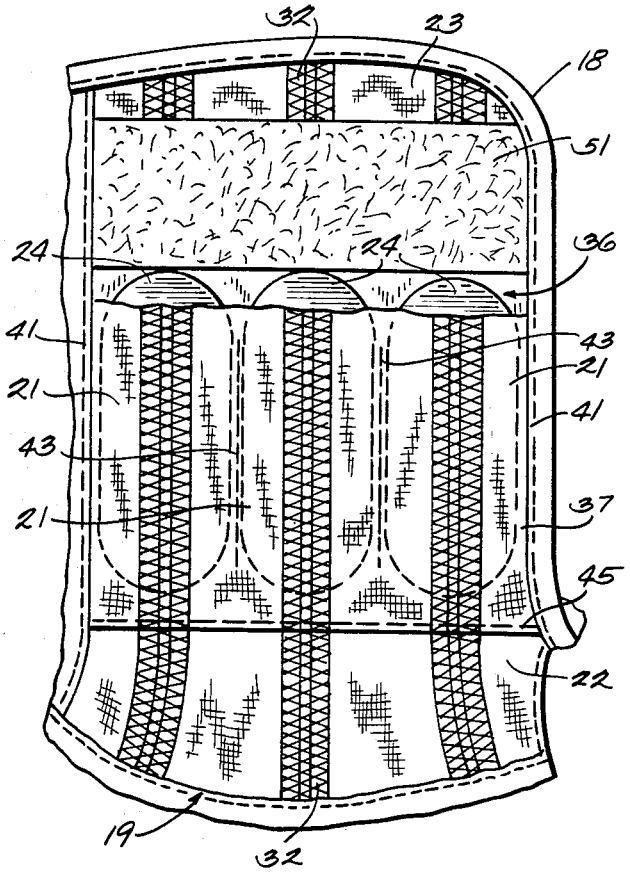
FIG. 9 is a plan view of a vented portion of the glove according to the invention, including pockets as shown in FIG. 7, with an outer elastic piece of material removed to show the insides of the pockets.

FIGS. 1 through 3 show an exercise glove 10 in accordance with the present invention. Exercise glove 10 includes a glove body 11 and series of three elastic pockets 21 for receiving a plurality of weights 24 therein. Glove body 11 includes open-ended half-fingers (finger portions) 12, 13, 14, 15, a palm-covering portion 16, an open-ended half-thumb (thumb portion) 17, a rounded cuff 18, and a vented back portion 19 overlying the back of the wearer's hand.

With specific reference now to FIGS. 2 and 3, weights 24 according to one aspect of the present invention each comprise an elongated, unitary substantially rectangular slab have rounded opposite end portions 26, 27. Rounded end portions 26, 27 facilitate insertion of each weight 24 into one of elastic pockets 21. Either end of weight 24 may be inserted first, since both ends are rounded. Each rounded end portion 26, 27 is roughly semi-circular and is integral with a central portion 28 of each weight 24. Each weight 24 has a pair of flat, top and bottom faces 25 and a pair of flat side surfaces 29.

The characteristics of weights 24 are as follows. All of the weights 24 are preferably identical, so that they can be used interchangeably. Each weight 24 weighs approximately at least three ounces. As shown in FIGS. 2 and 3, the width W of weight 24 is about twice the thickness T thereof. Thus, two weights 24 inserted into pocket 21 face down (on top and bottom faces 25) as shown in FIGS. 7 and 8, have about the same cross-sectional area as the same two weights 24 inserted edge down (on side surfaces 29) as shown in FIGS. 4 and 5. This makes weights 24 easier to use, since a wearer can insert them into pockets 21 face down or edge down with equal ease. Each weight 24 preferably has a length L of at least about two inches, a width W of at least about $\frac{5}{8}$ inch, and a thickness T of at least about $\frac{3}{8}$ inch. Weights 24 are preferably made of solid metal, most preferably a dense metal such as lead. Weights 24 can be coated with nickel to give them a lustrous silvery appearance, or can be formed of stainless steel. The covering (e.g., paint, plating) and/or the alloy weights 24 are made of should render weights 24 rust resistant. In their most preferred form, weights 24 thus comprise small, rather heavy metal slabs with attractive, shiny surfaces.

Referring now to FIG. 1 and FIGS. 4 through 9, glove body 11 is suitably shaped to conform to a human hand. Glove body 11 is primarily made up of palm-covering portion 16 and vented back portion 19 covering the back of the wearer's hand. If desired, the glove body 11 can further include finger portions 12 through 15, thumb portion 17, and cuff 18. All portions of glove body, 11 other than vented portion 19, are made of a conventional fabric or material for exercise gloves, such as leather, artificial (simulated) leather, deerskin, doeskin, calfskin, steerhide, nylon, nylon-acrylic, polyurethane-coated nylon, neoprene and terrycloth, among others. In the preferred embodiment, palm-covering portion 16, finger portions 12 through 15, thumb portion 17 and cuff 18 are made of leather. In general, glove body 11 covers at least the back of a wearer's hand. Since the exercise glove of the invention is not primarily designed to keep the wearer's hand warm, glove body 11 preferably includes only open-ended, partial coverings for the wearer's fingers and thumb.

Palm-covering portion 16 and vented back portion 19 covering the back of the hand are sewn together in a face-to-face relationship. Vented back portion 19 is substantially rectangular and extends from the base of finger portions 12 through 15 to cuff 18 in the lengthwise direction of glove 10. Vented portion 19 extends laterally from cuff 18 to thumb portion 17. Cuff 18 is generally L-shaped and defines continuous side and rear openings 33, 34 in glove body 11. Rear opening 33 allows the wearer's hand to be inserted into the glove. Side opening 34 acts as a vent, and helps the glove fit different sized hands, as will be explained below in connection with the wrist strap 52.

As best seen in FIG. 5 palm-covering portion 16 has a pair of inner linings 39, 40 sewn onto its inner side. A foam lining 39 made of a conventional foam material such as urethane foam lines the inside of palm-covering portion 16. A fabric lining 40 made of a soft, non-woven absorbent fabric overlies and covers foam lining 39. Linings 39, 40 generally conform in shape to the palm of the hand.

Vented back portion 19 has a structure specially adapted for the purposes of the present invention. A row of elastic pockets 21 is built into vented back portion 19 between a front part 22 and a rear part 23 of vented back portion 19. Front and rear parts 22, 23 are flat pieces of loosely woven, non-elastic nylon. For extra ventilation, vented portion 19 has several parallel lengthwise vents 32 at which the fabric is especially loosely woven. Vents 32 can be woven with a specific pattern so that they resemble decorative stripes on the back of the glove, as shown in FIG. 1.

As best seen in FIGS. 5 and 9, elastic pockets 21 are formed from a pair of inner and outer pieces of elastic material 37 and 38, respectively. Elastic pieces 37, 38 are disposed face-to-face and sewn at their opposite respective side edges along outer seams 41. Elastic pieces 37, 38 are also both sewn to front part 22 of vented portion 19 along a front seam 45 so that they define a large, elastic, rearwardly opening, single pocket. Elastic pieces 37, 38 are woven to match the pattern of front and rear parts 22, 23 so that vents 32 extend along the center of each pocket 21, as shown in FIG. 1. The woven fabric of elastic pieces 37,38 allows pockets 21 to stretch in a direction transverse to the lengthwise (finger-to-cuff) direction of glove 10, but does not allow pockets 21 to stretch in the lengthwise direction of the glove. Elastic pieces 37,38 are thus inelastic along the length of the glove, except that a small degree of stretching occurs due to the looseness of the weave.

A pair of lengthwise inner seams 43 also bind together elastic pieces 37, 38. These lengthwise inner seams 43 extend rearwardly from front seam 45. Inner seams 43 are parallel with outer seams 41 and divide the large, single pocket referred to above into three parallel pockets 21 of equal size. Inner seams 43 are shorter than outer seams 41 and shorter than the length L of weights 24. Elastic pockets 21 thus merge as they extend rearwardly to form a common opening 36 for all of elastic pockets 21. Common opening 36 facilitates removal and insertion of weights 24.

Elastic pockets 21 are typically at least about $\frac{3}{4}$ inch wide, as measured by the distance between the associated lengthwise inner seams 43 (for the center pocket 21) or inner and outer seams 41, 43 (for the left and right pockets 21). In general, the length and width of each elastic pocket 21 are slightly greater than the length L and width W, respectively, of weights 24. In particular, the width of each pocket 21 as measured by the distance between the associated lengthwise seams 43 (or 41 and 43) is about $\frac{1}{8}$ inch greater than the width W of each weight 24. Elastic pockets 21 can, however, stretch so that each pocket can snugly hold a single weight (FIG. 7) or a pair of weights (FIG. 8). Elastic pockets 21 can closely and snugly hold a pair of weights 24 face down (width down) as shown in FIGS. 7 and 8, or edge down (thickness down) as shown in FIGS. 4 and 5. Elastic pockets 21 according to the invention hold weights 24 securely so that weights 24 do not slide or move within pockets 21, regardless of whether pocket 21 contains one or two weights 24.

Glove 10 includes a particularly advantageous releasable contact closure device 50 which comprises a base element 51, a closure flap 47, and a wrist strap 52. A pair of releasable contact fasteners are built into closure device 50. Releasable contact closure device 50, in cooperation with the elasticity of pockets 21, keeps weights 24 within pockets 21, and additionally secures glove 10 to the wrist of the wearer, as will be described. A relatively wide hook tape base element 51 is affixed (e.g., sewn) onto rear part 23 of vented portion 19. As best shown in FIG. 9, base element 51 adjoins common opening 36 of elastic pockets 21 and extends laterally across common opening 36. A generally rectangular closure flap 47 is affixed (preferably sewn) to the upper periphery of common opening 36, that is, the rear edge of outer elastic piece 38. Closure flap 47 extends rearwardly. A hook tape element 48 and a loop tape element 49 are sewn to respective opposite faces of closure flap 47. In the embodiment shown, loop tape element 49 is disposed on the underside of closure flap 47, and hook tape element 48 is disposed on the outer side of closure flap 47. Closure flap 47 partially overlies hook tape base element 51, such that loop tape element 49 cooperates with and releasably engages a front portion of hook tape base element 51 when closure flap 47 is folded down to the position shown in FIGS. 1 and 6.

A wrist strap 52 cooperates with closure flap 47 and hook tape base element 51 to reinforce the closure of elastic pockets 21 while additionally securing glove 10 to the wrist of the wearer. Wrist strap 52 is secured to palm-covering portion 16 near cuff 18 and side opening 33, and extends laterally from glove body 11. A relatively wide loop tape element 53 is secured to the undersurface of wrist strap 52, to selectively releasably engage both hook tape element 48 on closure flap 47 and a rear portion of hook tape base element 48 not covered by closure flap 47. Wrist strap 52 thus secures closure flap 47 on its outer side while base element 51 secures closure flap 47 on its underside. Wrist strap 52 thus enhances the strength of the releasable contact closure device 50 for closing the pockets 21, and at the same time cooperates with cuff 18 to secure the glove 10 to the wrist of the wearer. Specifically, cuff 18 and wrist strap 52 cooperate to adjustably encircle the wearer's wrist.

To use the weight exercise glove according to the invention, the wearer will typically put on a matched pair of right and left gloves 10. The wearer puts on each glove 10 with closure flap 47 and wrist strap 52 hanging loose as shown in FIG. 4, and then inserts one or more weights 24 into one or more of elastic pockets 21. When the desired number of weights have been loaded into elastic pockets 21 of each glove 10, the wearer folds flap 47 down to engage loop tape element 49 with hook tape base element 51, then folds wrist strap 52 over to engage loop tape element 53 with hook tape element 48 and hook tape base element 51. To add or remove weights as desired, the wearer reverses this procedure to open pockets 21. Gloves 10 can be removed by releasing wrist strap 52 and pulling gloves 10 off without releasing closure flap 47.

Figure 10:
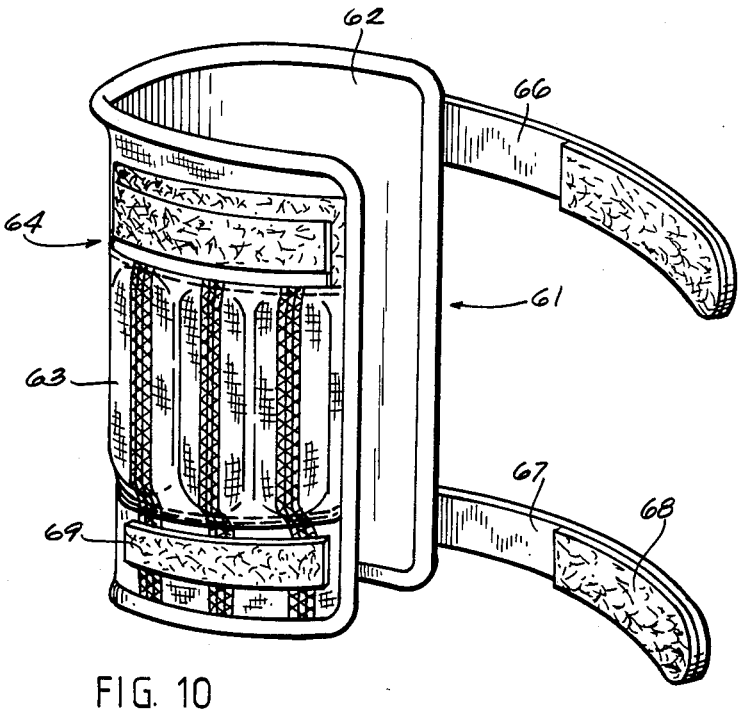
FIG. 10 is a perspective view of an exercise garment according to a further embodiment of the invention.

FIG. 10 illustrates a further embodiment of the invention. A exercise garment 61 comprises a garment body 62 having a row of elastic pockets 63. A closure device 64 including a strap 66 for opening and closing pockets 63 is substantially the same as the closure device of the preceeding embodiment described in connection with FIGS. 1 through 9. An additional strap 67 having a loop tape element 68 and an additional hook tape element 69 are secured to garment body 62 in appropriate positions so that straps 66, 67 can be used to removably secure exercise garment 61 to the wearer's body, such as around an arm or leg.

It will be understood that the above description is of preferred exemplary embodiments of the present invention, and the invention is not limited to the specific forms shown. For example, the cooperating hook tape and loop tape elements can be reversed in kind. Similarly, closure means other than hook and loop tape type fasteners can be employed. Respective snap elements can be deployed on vented portion 19 overlying the back of the hand to cooperate with corresponding snap elements on the undersides of closure flap 47 and wrist strap 52. Likewise, a second set of snap elements can be deployed on the outside of closure flap 47 to cooperate with corresponding snap elements on the underside of wrist strap 52. These and other modifications may be made in the design and arrangement of the elements without departing from the scope of the present invention as expressed in the appended claims.

I claim:

1. A garment, comprising:

a garment body;

a pocket disposed on said garment body having an open end;

a fastener base element secured to said garment body adjacent said open end of said pocket;

a closure flap secured to said pocket for selectively opening and closing said pocket, said closure flap having a first releasable fastener element secured to the underside thereof and further having a second releasable fastener element secured to the outside thereof, said first releasable fastener element being releasably engageable with said base element to secure said closure flap to said garment body; and a strap attached to said garment body, said strap having a third releasable fastener element secured thereto, said strap being positioned so that said third releasable fastener element can be releasably engaged with said second releasable fastener element as said first releasable fastener element engages said fastener base element to secure said garment to a wearer.

2. The garment of claim 1, wherein said third releasable fastener element can be releasably engaged with both of said base element and said second releasable fastener element.

3. The garment of claim 1, wherein said pocket comprises a plurality of elastic pockets, said elastic pockets being disposed in a row on said garment body, said pockets opening in lateral alignment with each other.

4. The garment of claim 3 further comprising a plurality of slab-shaped solid weights receivable in said elastic pockets, each elastic pocket being capable of snugly holding at least two of said weights in face-to-face contact with each other, said weights being removably securable in said pockets by said closure flap, said strap, and said first, second and third fastener elements so that the total weight of said garment can be adjusted by changing the number of said weights carried in said elastic pockets.

5. The garment of claim 1, wherein said first, second and third fastener elements comprise releasable contact fastener elements.

6. The garment of claim 5, wherein said releasable contact fastener elements comprise engagable hook tape and loop tape elements.

7. The garment of claim 1 wherein said strap is attached near an end of said garment body remote from said pocket, said garment body being foldable around a wearer.

8. A glove comprising:

a glove body having a back adapted to overlie the back of a hand and a rear opening for receiving a hand; and a pocket disposed on said back of said glove body, said pocket having means for receiving a variable number of objects each having a length and width slightly less than the length and width, respectively, of said pocket, and means for stretching elastically in a direction transverse to the lengthwise direction of said glove so that said pocket can stretch to retain a variable number of such objects, up to a predetermined maximum number of such objects, so that the objects can be snugly received in said pocket irrespective of the number of objects within said pocket; and closure means for opening and closing said pocket, wherein said closure means comprises:

a releasable contact fastener base element secured to said back of said glove body;

a closure flap secured to said pocket for opening and closing said pocket, said closure flap having a first releasable contact fastener element secured to the underside thereof and further having a second releasable contact fastener element secured to the outside thereof, said first releasable contact fastener element being releasably engageable with said base element to secure said closure flap to said back of said glove body; and a wrist strap attached to said glove body, said wrist strap having a third releasable contact fastener element secured thereto, said wrist strap being positioned so that said third releasable contact fastener element can be releasably engaged with both of said base element and said second releasable contact fastener element to releasably secure said glove to the hand.

9. The glove of claim 8, wherein said releasable contact fastener elements comprise engageable hook tape elements and loop tape elements.

10. The glove of claim 8, wherein said glove body further has a side opening which is continuous with said hand-receiving opening, said wrist strap being secured to said glove body so that said wrist strap is folded over said side opening to bring said third releasable contact fastener element into adhering contact with said base element and said second releasable contact fastener element.

11. An exercise glove, comprising:

a glove body having a back adapted to overlie the back of a hand, a palm-covering portion adapted to cover the palm of the hand, and a rear opening for receiving a hand;

a plurality of elastic pockets disposed on said back of said glove body, said pockets being elongated in the lengthwise direction of said glove body, each of said elastic pockets opening rearwardly and in lateral alignment with each other;

a releasable contact fastener base element secured to said back of said glove body rearwardly of said row of elastic pockets;

a closure flap secured to said pockets and extending rearwardly therefrom over said openings of said pockets;

a first releasable contact fastener element affixed to the underside of said closure flap, said first releasable contact fastener element being engageable with a front portion of said releasable contact fastener base element to releasably secure said closure flap to said glove body and close said pockets;

a second releasable contact fastener element affixed to the outside of said closure flap;

a wrist strap attached at one end thereof to said glove body near to said rear opening for receiving a hand;

a third releasable contact fastener element affixed to said wrist strap, said third releasable contact fastener element being engageable with both of said second releasable contact fastener element and a second portion of said releasable contact fastener base element to releasably secure said wrist strap to both of said closure flap and said back of said glove body and to releasably secure said glove on the hand; and a plurality of slab-shaped solid weights receivable in said elastic pockets, each elastic pocket being capable of snugly holding at least two of said weights in face-to-face contact with each other, and each elastic pocket further being capable of snugly holding one of said weights, said weights being removably securable in said pockets by said closure flap, said wrist strap, and said releasable contact fastener elements, whereby the total weight of said glove can be adjusted by changing the number of said weights carried in said pockets.

* * * * *

UNITED STATES PATENT AND TRADEMARK OFFICE

CERTIFICATE OF CORRECTION

PATENT NO. : 4,684,123

DATED : August 4, 1987

INVENTOR(S) : John J. Fabry

It is certified that error appears in the above-identified patent and that said Letters Patent is hereby corrected as shown below:

On the first page of the patent, following the title, the inventor's name --JONN J. FABRY-- should be correctly spelled --JOHN J. FABRY--.

Signed and Sealed this

First Day of December, 1987

*Attest:*

DONALD J. QUIGG

*Attesting Officer*

*Commissioner of Patents and Trademarks*